United States Patent [19]

Yamauchi

[11] Patent Number: 4,547,316

[45] Date of Patent: Oct. 15, 1985

[54] INSULATING GAS FOR ELECTRIC DEVICE

[75] Inventor: Shiro Yamauchi, Nishinomiya, Japan

[73] Assignee: Mitsubishi Denki Kabushiki Kaisha, Tokyo, Japan

[21] Appl. No.: 618,824

[22] Filed: Jun. 8, 1984

[30] Foreign Application Priority Data

Jun. 16, 1983 [JP] Japan ..... 58-109600

[51] Int. Cl.[4] ..... H01B 3/56

[52] U.S. Cl. ..... 252/571; 252/372; 174/17 GF; 174/25 G; 174/26 G; 200/146 AA; 200/148 G; 336/94; 361/327

[58] Field of Search ..... 252/372, 571; 174/17 GF, 25 G, 26 G; 200/146 AA, 148 G; 336/94; 361/327

[56] References Cited

U.S. PATENT DOCUMENTS 3,048,648 8/1962 Plump et al. ..... 252/571

OTHER PUBLICATIONS

J. C. Devins, "Replacement Gases for $SF_6$", Proc. Conference on Electrical Insulation and Dielectric Phenomena, pp. 398–408, (1977).

Kirk–Othmer, Encyclopedia of Chemical Technology, 3rd ed., vol. 7, pp. 307–319.

*Primary Examiner*—Paul Lieberman

*Assistant Examiner*—Robert A. Wax

*Attorney, Agent, or Firm*—Wenderoth, Lind & Ponack

[57] ABSTRACT

An insulating gas for an electric device which comprises pentafluoropropionitrile or a mixture of pentafluoropropionitrile and sulfur hexafluoride and at least one nitrite ester selected from methyl nitrite, ethyl nitrite, propyl nitrite, butyl nitrite, and amyl nitrite. The effects of pentafluoropropionitrile on humans can be moderated by addition of the nitrite ester.

4 Claims, 2 Drawing Figures

INSULATING GAS FOR ELECTRIC DEVICE

BACKGROUND OF THE INVENTION

1. Field of the Invention

The present invention relates to an insulating gas for an electric device having increased insulating strength.

2. Description of the Prior Art

Recently, there has been adopted a method in which sulfur hexafluoride gas (hereinafter referred to as "$SF_6$ gas") is filled in a vessel in which an electric device is disposed, as shown in FIG. 1, whereby good insulating properties are maintained and the size of the electric device is decreased. In FIG. 1, reference numeral 1 represents a vessel, reference numeral 2 represents $SF_6$ gas which fills the vessel 1, reference numeral 3 represents a bushing, reference numeral 4 represents a disconnecting portion, reference numeral 5 represents a breaking portion, and reference numeral 6 represents a conductor connecting the disconnecting portion 4 to the breaking portion 5.

Accordingly, in a gas-insulated electric device having a live part supported by a solid insulating member, such as a gas-insulated switch or bus bar, the size of the electric device is diminished and the reliability is improved, and the device is made more suitable for use in its environment.

However, further reductions in size are desired because of increased demand for electric power or because of problems related to land shortages, and use of a gas having better insulating properties than $SF_6$ gas is now considered.

Pentafluoropropionitrile (hereinafter referred to as "$C_2F_5CN$") is one example of a gas having a higher insulating strength than $SF_6$ gas. It has an insulating strength 1.8 times as high as that of $SF_6$ gas and it is a chemically stable compound. Accordingly, it is considered that $C_2F_5CN$ is promising as an insulating gas for electric devices.

However, since $C_2F_5CN$ has not been actually used, the effects of this gas on humans are not known, and if $C_2F_5CN$ remains in the vessel, safety and sanitation problems can arise when the electric device is checked.

SUMMARY OF THE INVENTION

It is a primary object of the present invention to provide an insulating gas for an electric device which has a high insulating strength and which has a reduced effect on humans due to the addition of a nitrite ester in a specific amount to $C_2F_5CN$.

More specifically, in accordance with the present invention, there is provided an insulating gas for an electric device which comprises pentafluoropropionitrile ($C_2F_5CN$) and at least one nitrite ester selected from methyl nitrite, ethyl nitrite, propyl nitrite, butyl nitrite, and amyl nitrite.

DETAILED DESCRIPTION OF THE PREFERRED EMBODIMENTS

The present invention will now be described in detail.

Figure 1:
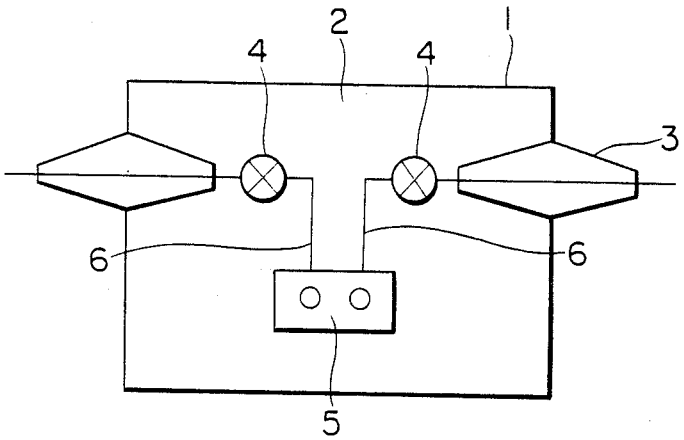
FIG. 1 is a diagram illustrating the structure of a gas-insulated electric device.
Figure 2:
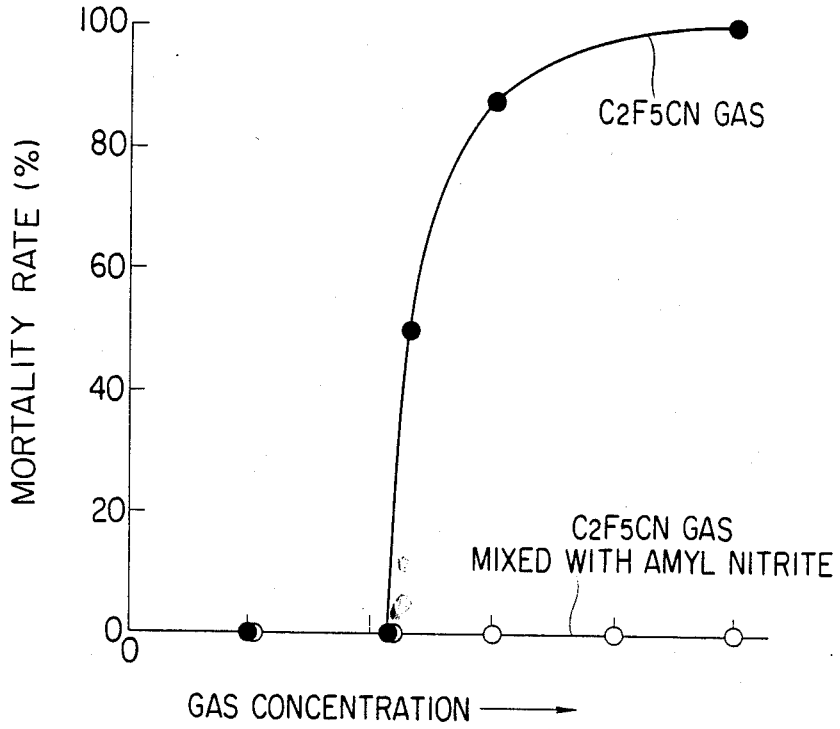
FIG. 2 is a graph showing the effect of the insulating gas of the present invention.

In order to ascertain the effects of $C_2F_5CN$ on humans, an acute inhalation toxicity test was carried out using rats. When rats were exposed to $C_2F_5CN$ diluted with air, the results indicated by the solid circles (•) in FIG. 2 were obtained.

From the results shown in Table 2, it is seen that the 50% lethal concentration LC50 of $C_2F_5CN$ for rats is 2731 ppm when the exposure time is 4 hours, and the minimum lethal concentration is 2150 ppm. Thus, it was confirmed that the effects of $C_2F_5CN$ on humans are comparable to those of ammonia, which has an LC50 value of 2000 ppm for rats for 4 hours exposure.

The present inventor found that when nitrite esters, including amyl nitrite and ethyl nitrite, which are effective as vasodilators, are added to $C_2F_5CN$, the effects of $C_2F_5CN$ are moderated.

It is indispensable that the nitrite ester to be used with $C_2F_5CN$ should not be liquefied in an electric device. Accordingly, nitrite esters having a boiling point not higher than 96° C., such as methyl nitrite (having a boiling point of −16° C.), ethyl nitrite (having a boiling point of 17.4° C.), propyl nitrite (having a boiling point of 47° C.), butyl nitrite (having a boiling point of 79° C.) and amyl nitrite (having a boiling point of 96° C.), are preferably used as the additives in the present invention.

An acute inhalation toxicity test was conducted on rats using 2 mole % amyl nitrite added to 98 mole % $C_2F_5CN$. When rats were exposed for 4 hours to this insulating gas diluted with air, the results indicated by the hollow circles (0) in FIG. 2 were obtained. From the results shown in FIG. 2, it is seen that by adding amyl nitrite to $C_2F_5CN$ gas, the effects of $C_2F_5CN$ gas on humans can be significantly moderated. Similar effects can be obtained if methyl nitrite, ethyl nitrite, propyl nitrite, or butyl nitrite is used instead of amyl nitrite, each of which possesses an ONO radical.

Although the above experiments with rats were carried out for 4 hours, the actual time for which a human worker inspecting an electrical apparatus might be exposed to $C_2F_5CN$ is at most 1/10 of an hour. Accordingly, only 2 mole % × (0.1 hours ÷ 4 hours) = approximately 0.05 mole % of a nitrite ester is sufficient to moderate the effects of $C_2F_5CN$ gas on humans inspecting an electrical apparatus employing $C_2F_5CN$.

The maximum amount of nitrite ester which may be added is determined according to the characteristic properties of the additive, such as the vapor pressure, and according to operating conditions, such as temperature. Ordinarily, however, it is appropriate that the nitrite ester be added in an amount of no more than approximately 10 mole %.

The foregoing description has been made with reference to an embodiment where $C_2F_5CN$ alone is used as the insulating gas for an electric device. Similar effects can be expected when the nitrite ester is added to an insulating gas comprising sulfur hexafluoride ($SF_6$) and a predetermined amount of $C_2F_5CN$.

According to the present invention, by adding a predetermined amount of at least one nitrite ester selected from methyl nitrite, ethyl nitrite, propyl nitrite, butyl nitrite, and amyl nitrite to pentafluoropropionitrile ($C_2F_5CN$) or to a mixture of pentafluoropropionitrile and sulfur hexafluoride ($SF_6$), the effects of $C_2F_5CN$ on humans can be moderated, and an insulating gas having a high insulating strength which has reduced effect on humans can be obtained.

What is claimed is:

1. An insulating gas mixture for an electric device, which comprises pentafluoropropionitrile and at least one nitrite ester selected from methyl nitrite, ethyl nitrite, propyl nitrite, butyl nitrite, and amyl nitrite.

2. An insulating gas mixture according to claim 1, wherein the amount of the nitrite ester is approximately 0.05 to 10 mole %.

3. An insulating gas mixture for an electric device, which comprises pentafluoropropionitrile, sulfur hexafluoride, and at least one nitrite ester selected from methyl nitrite, ethyl nitrite, propyl nitrite, butyl nitrite, and amyl nitrite.

4. An insulating gas mixture according to claim 3, wherein the amount of the nitrite ester is approximately 0.05 to 10 mole %.

* * * * *